US009508358B2

(12) United States Patent
Srinivasan

(10) Patent No.: US 9,508,358 B2
(45) Date of Patent: Nov. 29, 2016

(54) NOISE REDUCTION SYSTEM WITH REMOTE NOISE DETECTOR

(75) Inventor: Sriram Srinivasan, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 162 days.

(21) Appl. No.: 13/993,100

(22) PCT Filed: Dec. 7, 2011

(86) PCT No.: PCT/IB2011/055515

§ 371 (c)(1),
(2), (4) Date: Jun. 11, 2013

(87) PCT Pub. No.: WO2012/080907

PCT Pub. Date: Jun. 21, 2012

(65) Prior Publication Data

US 2013/0262101 A1 Oct. 3, 2013

(30) Foreign Application Priority Data

Dec. 15, 2010 (EP) ..... 10306412

(51) Int. Cl.
*G10L 21/0208* (2013.01)
*G10L 21/0216* (2013.01)

(52) U.S. Cl.
CPC .. *G10L 21/0208* (2013.01); *G10L 2021/02165* (2013.01)

(58) Field of Classification Search
CPC ... G10L 15/20; G10L 21/02; G10L 21/0205; G10L 2021/02082; G10L 2021/02085; G10L 2021/02087; G10L 21/0216; G10L 2021/02161; G10L 2021/02165
USPC ..... 704/200, 201, 224, 225, 226, 233, 234, 704/250, 255, 256, 266
See application file for complete search history.

(56) References Cited

U.S. PATENT DOCUMENTS 7,478,043 B1 1/2009 Preuss
2006/0136203 A1* 6/2006 Ichikawa ..... G10L 21/0208 704/226
2009/0238377 A1 9/2009 Ramakrishnan
2009/0323976 A1* 12/2009 Asada ..... G10K 11/178 381/71.1

(Continued)

FOREIGN PATENT DOCUMENTS

CN 101083640 A 12/2007
EP 1914726 A1 4/2008

(Continued)

OTHER PUBLICATIONS

S. Srinivasan et al., "Codebook-Based Bayesian Speech Enhancement for Nonstationary Environments", IEEE Transactions on Audio, Speech, and Language Processing, vol. 15, No. 2, Feb. 2007, pp. 441-452.

(Continued)

*Primary Examiner* — Huyen Vo
*Assistant Examiner* — Rodrigo Chavez
(74) *Attorney, Agent, or Firm* — Larry Liberchuk

(57) ABSTRACT

Noise reduction system with remote noise detector The present invention relates to a noise reduction system with at least one remote noise detector placed close to at least one noise source, which transmits relevant information to a primary device where it is used for noise reduction. Thereby, acoustic signal enhancement can be achieved via the at least one remote noise detector in that a noise estimate is transmitted to controller for noise reduction in the signal obtained from a primary source.

12 Claims, 2 Drawing Sheets

(56) References Cited

U.S. PATENT DOCUMENTS

| | | | | |
|---|---|---|---|---|
| 2010/0004929 | A1* | 1/2010 | Baik | G10L 21/0208 704/233 |
| 2010/0014685 | A1* | 1/2010 | Wurm | G10K 11/178 381/71.11 |
| 2010/0048131 | A1* | 2/2010 | Hirsch | H04R 3/005 455/41.3 |
| 2010/0056063 | A1* | 3/2010 | Sudo | G10L 21/0208 455/63.1 |
| 2010/0166225 | A1* | 7/2010 | Watanabe | H03G 3/32 381/107 |
| 2010/0296669 | A1* | 11/2010 | Oh | H03G 9/005 381/109 |

FOREIGN PATENT DOCUMENTS

| | | | |
|---|---|---|---|
| WO | WO0049602 | A1 | 8/2000 |
| WO | WO0137439 | A2 | 5/2001 |
| WO | WO2006066618 | A1 | 6/2006 |
| WO | WO2008082793 | A2 | 7/2008 |
| WO | WO2010005493 | A1 | 1/2010 |

OTHER PUBLICATIONS

S. Rangachari et al., "A Noise-Estimation Algorithm for Highly Non-Stationary Environments", Speech Communication, vol. 48, Issue 2, Feb. 2006, pp. 220-223.

J. Freudenberger et al., "A Noise PSD and Cross-PSD Estimation for two-Microphone Speech Enhancement Systems", 2009 IEEE/SP 15th Workshop on Statistical Signal Processing, pp. 709-712.

Yousefian et al., "Power Level Difference as a Criterion for Speech Enhancement", Acoustics, Speech and Signal Processing, Apr. 2009. ICASSP 2009. IEEE International Conference, pp. 4653-4656.

* cited by examiner

NOISE REDUCTION SYSTEM WITH REMOTE NOISE DETECTOR

FIELD OF THE INVENTION

The invention relates to a noise reduction apparatus, method and system for reducing background noise and/or interference during reception of an acoustic signal.

BACKGROUND OF THE INVENTION

Enhancement of speech corrupted by background noise and interference remains a challenging problem, especially for highly varying interfering audio or acoustic signals such as music. This is a relevant problem in several application domains, e.g., mobile telephony, hands-free communication, hearing aids, etc. As voice over Internet Protocol (VoIP) communication becomes increasingly common in living rooms, a new application scenario emerges, where one person in a home is involved in a VoIP call, e.g., on a personal computer (PC), while another person is watching television (TV) or listening to music, in the same room. As VoIP conversations tend to be long, these scenarios demand increasing attention. The challenge is to transmit only the voice of the talker while suppressing background noise or interference, e.g., the sound from the TV or music system.

SUMMARY OF THE INVENTION

It is an object of the present invention to provide an enhanced noise reduction system which provides reduced background noise or interference during audio reception via an acoustic receiver.

This object is achieved by a noise reduction apparatus as claimed in claim 1, by a remote noise detector as claimed in claim 8, by a method as claimed in claim 14, by a noise reduction system as claimed in claim 13, and by a computer program product as claimed in claim 15.

Accordingly, at least one remote detector, such as a remote wireless microphone (RWM) or the like, is placed close to at least one noise source, which transmits relevant noise information to a primary device where it is used for noise reduction. As portable wireless audio-enabled devices are becoming increasingly common, it is possible to form an ad-hoc network of such devices to enable high quality speech capture, especially in the presence of noise. Specifically, placing such a device close to each source of an interfering signal, and wirelessly transmitting appropriate features derived from that device's audio or acoustic signal to the primary device can provide significant advantages for noise reduction.

Current single-microphone speech enhancement techniques suffer from poor performance in non-stationary noise conditions, and fail to provide any improvement in quality or intelligibility in the presence of highly varying interferences such as music. The proposed solution overcomes this limitation by the use of the remote wireless detector (e.g. microphone) placed near the noise source. A natural extension of this solution is that multiple noise sources can be cancelled or compensated by placing a wireless noise detector near each one of them, and having them transmit their signals to the noise reduction apparatus.

Microphone arrays have been shown to be capable of reducing non-stationary interferences such as music but this approach requires the installation of such an array. This solution eliminates the need for dedicated hardware such as an array, and uses already available detectors (such as microphones) in the user's environment. Moreover, non-stationary noise reduction using microphone arrays works best when the interferer is reasonably close to the array, which may not always be the case. The proposed solution overcomes this limitation.

If the noise estimation signal from the remote noise detector is combined with that of the primary acoustic receiver (e.g. microphone) using a beamformer, accurate synchronization of the clocks of the individual devices containing the microphones becomes necessary.

According to a first aspect, the acoustic receiver may comprise a first microphone adapted to receive the acoustic signal from the primary acoustic source. Thereby, background noise from a remote noise source can detected for efficiently and can be reduced or cancelled during reception of an acoustic signal at the first microphone.

According to a second aspect which can be combined with the first aspect, the noise reduction processor may comprise a level adjustment unit, stage or function for compensating a level difference between the received noise estimates and the noise component in the received acoustic signal based on a speech model on a frame-by-frame basis. Thus, quickly varying background noise can be compensated.

According to a third aspect which can be combined with at least one of the first and second aspects, the received noise estimate may be a power spectral density of a noise or interference received at said remote noise detector. Thus, by only transmitting the power spectral density (PSD) of the signal of the remote noise detector, only the positive frequencies need to be transmitted as the PSD is symmetric, and this results in power savings as fewer bits need to be transmitted. Further power savings can be attained by transmitting the PSD at a lower spectral resolution, thereby introducing an adjustable trade-off between power consumption and performance. Additionally, clock synchronization is not required.

According to a fourth aspect which can be combined with at least one of the first to third aspects, the noise reduction processor may comprise a path estimation unit, stage or function for estimating an acoustic path between the remote noise detector and said acoustic receiver. This provides the advantage that the acoustic path can be compensated for.

According to a fifth aspect which can be combined with at least one of the first to fourth aspects, the noise reduction processor comprises a speech enhancement unit, stage or function for exploiting the received noise estimate by a single-channel speech enhancement algorithm.

According to a sixth aspect which can be combined with at least one of the first to fifth aspects, the noise reduction apparatus and the remote noise detector may be adapted to connect to each other via an ad hoc network connection. This enables high quality capture of acoustic signals.

According to a seventh aspect which can be combined with at least one of the first to sixth aspects, the remote noise detector may be adapted to transmit a time domain waveform to the noise reduction apparatus during a start-up phase, so as to enable path estimation and thus compensation.

In a further aspect of the present invention a computer program for performing noise reduction is provided, wherein the computer program comprises code means for causing the noise reduction apparatus to carry out the steps of the above noise reduction method, when the computer program is run on a computer controlling the noise reduction apparatus.

It shall be understood that a preferred embodiment of the invention can also be any combination of the dependent claims with the respective independent claim.

These and other aspects of the invention will be apparent from and elucidated with reference to the embodiments described hereinafter.

DETAILED DESCRIPTION OF EMBODIMENTS

Figure 1:
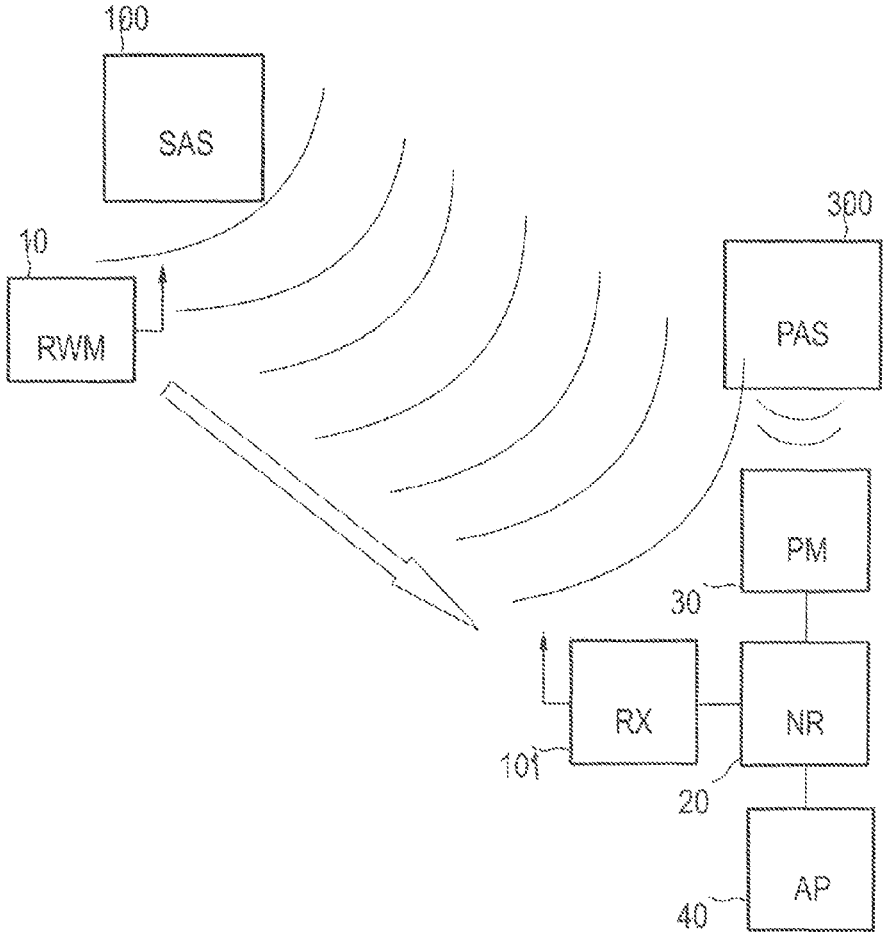
FIG. 1 shows schematically and exemplarily an embodiment of a noise reduction system.

FIG. 1 shows a noise reduction system according to an embodiment where a primary acoustic source (PAS) 300, such as a user's voice for a VoIP call or any other source of a desired acoustic signal, is received via a primary microphone (PM) 30 or any other detector for acoustic or audio signals. The detected audio signal is supplied to a noise reduction unit (NR) 20 adapted to cancel or suppress noise and/or interference added during the signal detection process. More specifically, the noise reduction unit or processor 20 is adapted to determine or estimate any noise and/or interference added to the desired signal by other remote secondary acoustic sources (SAS), such as the secondary acoustic source 100 depicted in FIG. 1. The secondary acoustic source 100 may be a television (TV) device, a music player or any other source of background noise or interference which influences the desired signal to be detected by the primary microphone 30. Interference and/or noise determination at the noise reduction processor is achieved by placing at least one remote wireless microphone (RWM) 10 in the vicinity of the secondary acoustic source 100, so as to detect the interference or noise at the secondary acoustic source 100 and transfer a detected noise/interference signal via a wireless connection to a wireless receiver (RX) 101 at the noise reduction processor 20. The received noise/interference signal is supplied to the noise reduction processor 20 where it is used for noise/interference estimation and subsequent noise reduction or cancellation. The processed acoustic or audio signal is supplied to an audio processing (AP) stage 40 where it is processed based on the concerned audio application, e.g., a VoIP application for transferring the audio signal via the Internet to a called party.

The remote microphone 10 may be implemented as a portable wireless device and may be adapted to form an ad-hoc network with the wireless receiver 101 at the noise reduction processor 20 to enable high quality speech capture, especially in the presence of noise. A wireless ad-hoc network is a decentralized wireless network. The network is ad hoc because it does not rely on a preexisting infrastructure, such as routers in wired networks or access points in managed (infrastructure) wireless networks. Instead, each node participates in routing by forwarding data for other nodes, and so the determination of which nodes forward data is made dynamically based on the network connectivity. The decentralized nature of wireless ad-hoc networks (such as mobile ad hoc networks, wireless mesh networks or wireless sensor networks) makes them suitable for the present noise reduction system where central nodes cannot be relied on. Of course, other types of wireless links, e.g. links according to the 802.11 standards, may be used for signaling purposes between the remote microphone 10 and the noise reduction processor 20.

Thus, the proposed noise reduction system according to the embodiment comprises the primary microphone 30 and one or more remote wireless microphones 10 placed close to the secondary acoustic sources, e.g. noise source(s). In the embodiment, the remote microphone(s) 10 are adapted to transmit a power spectral density (PSD) of the observed and detected noise/interference signals to the noise reduction processor 20 at the primary microphone 30, and these serve as estimates of the noise PSD, subject to a level difference that needs to be compensated for.

At the noise reduction processor 20 of the primary microphone 30, the level difference between the received PSDs from the remote microphone(s) 10 and the level of the PSD of the noise signal observed at the primary microphone 30 is compensated for using a model-based approach, and then subsequently used to suppress the noise from the noisy signal observed at the primary microphone 30.

An important question in the set-up introduced above is the signal that the remote microphone(s) 10 should transmit. If the signals from the local and remote microphones are to be used as input to a beamformer, then transmitting a time-domain waveform is necessary. However, wireless transmission of data is power-intensive. In addition, as the primary microphone 30 and the remote microphone(s) 10 are connected to separate devices with independent clocks, mechanisms to accurately synchronize the two clocks become essential. Furthermore, since the distance between the two microphones can be large (e.g., 2-4 meters), the beamformer will suffer from spatial aliasing at the frequencies of interest.

Figure 2:
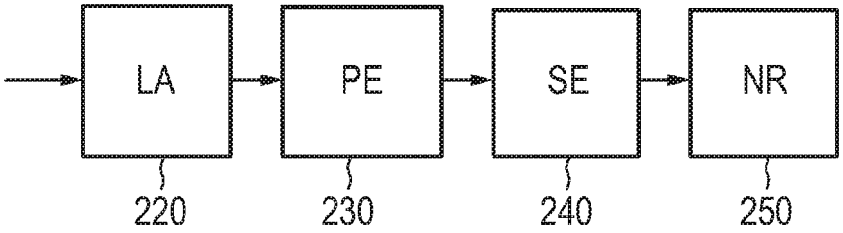
FIG. 2 shows schematically and exemplarily an embodiment of a noise reduction apparatus.

FIG. 2 shows schematically and exemplarily an embodiment of the noise reduction processor 20. In a level adjustment (LA) stage 220, a frequency-independent level difference is compensated for, due to the fact that the primary microphone 30 and the remote microphone(s) 10 are separated by a distance. Transmitting an estimate of the power spectral density (PSD) of the observed noise/interference signal has several advantages. As the remote microphone(s) 10 is(are) closer to the noise source than the primary microphone 30, the PSD of the signal observed at the remote microphone(s) 10 is a good approximation of the noise PSD at the primary microphone 30, at moderate levels of reverberation. The use of a speech model as described for example in S. Srinivasan, J. Samuelsson and W. B. Kleijn, "Codebook-based Bayesian speech enhancement for non-stationary environments", IEEE transactions on audio, speech, and language processing, vol. 15, no. 2, 2007, allows the computation of this level adjustment on a frame-by-frame basis and can thus deal with quickly varying noise (a frame is a short segment of the speech signal, typically between 20 to 32 milliseconds long).

Reverberation is the persistence of sound in a particular space after the original sound is removed. A reverberation, or reverb, is created when a sound is produced in an enclosed space causing a large number of echoes to build up and then slowly decay as the sound is absorbed by the walls and air This is most noticeable when the sound source stops but the reflections continue, decreasing in amplitude, until they can no longer be heard. In comparison to a distinct echo that is 50 to 100 ms after the initial sound, reverberation is many thousands of echoes that arrive in very quick succession (0.01-1 ms between echoes). As time passes, the volume of the many echoes is reduced until the echoes cannot be heard at all. Hence, if the amount of reverberation in the environment of the noise reduction system is high, then the PSD of the signal at the remote microphone(s) 10 and the noise PSD at the primary microphone 30 no longer differ by just a frequency-independent level factor. In this case, an optional path estimation (PE) stage 230 may be provided, and during a start-up phase, each of the remote microphones 10 may send its time domain waveform to the noise reduction processor 20, where the acoustic path between each of the remote microphones 10 and the primary microphone 30 can be estimated in the path estimation stage 230 using for example a normalized least mean squares filter. Once known, this path can be compensated for. The two PSDs then only vary by a frequency-independent level factor, and it is sufficient to transmit PSDs alone.

The level-adjusted and optionally speech compensated noise PSD of the remote microphone signal can then be exploited by a single-channel speech enhancement algorithm in a speech enhancement (SE) stage 240. Estimation of the noise PSD from a single noisy signal is challenging, especially under non-stationary noise conditions, and therefore accurate noise PSD information from the remote microphone 10 can provide significant improvements in noise reduction in a subsequent noise reduction (NR) stage 250. By transmitting the noise PSD calculated every 20-32 ms, for example, it is possible to track highly varying noise types such as music. As only spectral information needs to be transmitted, accurate clock synchronization is no longer essential. Moreover, as the PSD of a real signal is symmetric, it is sufficient to transmit only the positive frequencies, thereby reducing the power consumption compared to transmitting the raw signal. To further reduce the transmission bandwidth, not all frequency bins need to be transmitted. Instead, the PSD can be transmitted at a reduced spectral resolution.

Figure 3:
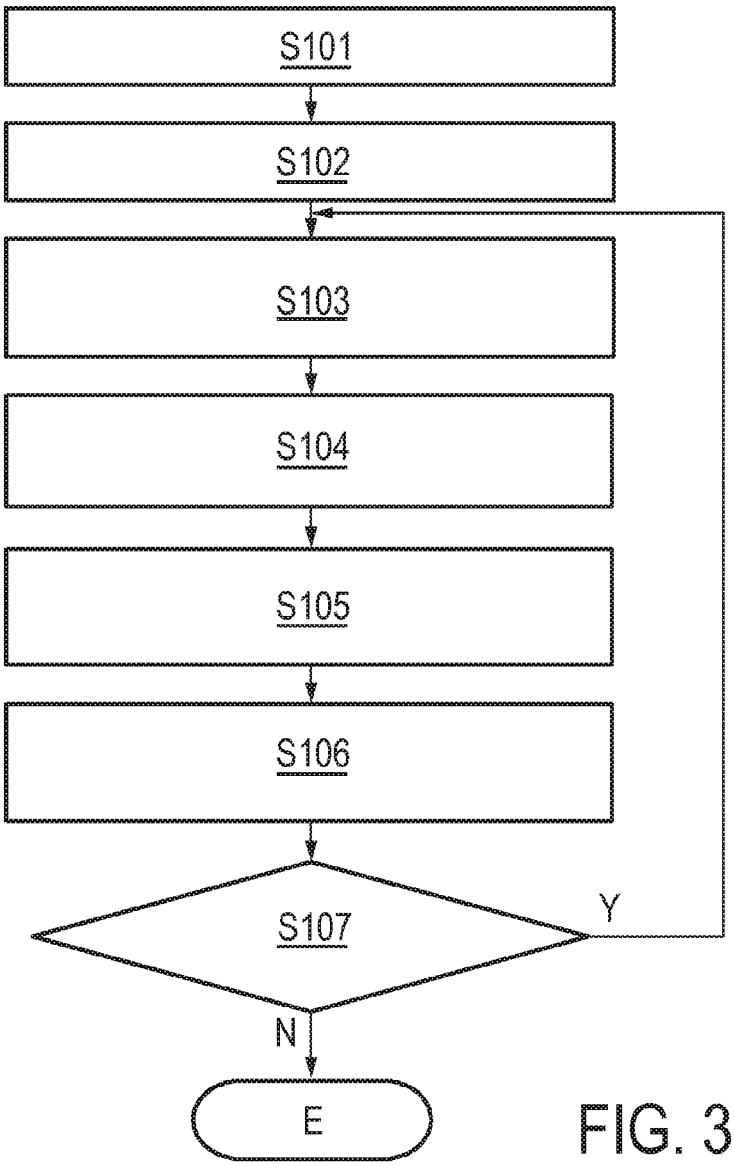
FIG. 3 shows exemplarily a flowchart illustrating an embodiment of a noise reduction method.

FIG. 3 shows exemplarily a flowchart illustrating an embodiment of a noise reduction method which could be applied in the noise reduction processor 20.

In step S101, an initial path estimation is performed on the basis of a time domain waveform received from each remote microphone. Then, in step S102, path compensation parameters are set accordingly. In step S103, a noise estimate is received from the remote microphone (RWM) 10 and a level adjustment is performed in step S104 e.g. based on the above speech model. Then, in step S105 path estimation and speech alignment processing is applied to the level-adjusted signal. Finally, in step S106, a noise reduction processing is applied to the signal from the primary microphone 30 based on the estimated noise and/or interference. Thereafter, it is checked in step S107 whether further noise estimates have been received from the remote microphone(s) 10. If not, the procedure ends. Otherwise, if further noise estimates are available, the procedure jumps back to step S103 and the processing in steps S103 to S106 is repeated until no further noise estimates are vailable.

Improvements in segmental signal-to-noise ratio (SNR) for speech corrupted by three different types of music have been examined. Results have been averaged over 10 different speech utterances, each at an input SNR of 0 dB. The desired and the interfering signals were played from two loudspeakers placed approx. 3 m apart. The primary microphone 30 was located 0.5 m away from the desired primary acoustic source 300, as is typical in a VoIP call on a PC. The remote microphone 10 was placed close to the loudspeaker playing the music signal. The reverberation time (T60) is the time required for reflections of a direct sound to decay by 60 dB below the level of the direct sound. T60 of the test room was approx. 400 ms. For the proposed noise reduction approach, the PSD of the signal observed by the RWM was used as an estimate of the noise PSD, and the noisy speech observed at the primary microphone was processed using the above exemplary speech model, which can compensate for the level difference between the PSD of the signal of the remote microphone 10 and the noise PSD at the primary microphone 30. For comparisons, a state-of-the-art noise estimation scheme for non-stationary noise conditions as described for example in S. Rangachari and P. C. Loizou, "A noise-estimation algorithm for highly non-stationary environments", Speech Communication, Volume 48, Issue 2, February 2006, Pages 220-23, was used to enhance the noisy speech. As expected, current schemes cannot cope with highly non-stationary interferences, and the proposed noise reduction approach with remote noise detector provides a significant improvement in performance.

The above embodiments may be enhanced in that multiple secondary acoustic sources are suppressed by placing one remote microphone or detector near each one of them, and having them transmit their noise information (e.g. PSDs) to the primary microphone. As an alternative, multiple remote microphones or detectors may be placed near one secondary acoustic source to improve noise estimation. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

A single unit or device may fulfill the functions of several items recited in the claims. The mere fact that certain measures are recited in mutually different dependent claims does not indicate that a combination of these measures cannot be used to advantage.

Steps S101 to S107 can be performed by a single unit or by any other number of different units. The calculations, processing and/or control of the noise reduction processor 20 can be implemented as program code means of a computer program and/or as dedicated hardware.

A computer program may be stored/distributed on a suitable medium, such as an optical storage medium or a solid-state medium, supplied together with or as part of other hardware, but may also be distributed in other forms, such as via the Internet or other wired or wireless telecommunication systems.

Any reference signs in the claims should not be construed as limiting the scope.

The present invention relates to a noise reduction system with at least one remote noise detector placed close to at least one noise source, which transmits relevant information to a primary device where it is used for noise reduction. Thereby, audio signal enhancement can be achieved via the at least one remote noise detector in that a noise estimate is transmitted to a controller for noise reduction in the signal obtained from a primary source.

The invention claimed is:

1. A noise reduction apparatus for reducing at least one of background noise and interference during reception of an audio signal, said noise reduction apparatus comprising:

a wireless receiver for receiving a noise estimate, wherein the received noise estimate is power spectral density of a noise or interference remotely detected and wirelessly transmitted by at least one remote noise detector to the wireless receiver, and wherein the power spectral density is transmitted at a reduced spectral resolution in order to reduce a transmission bandwidth between the at least one remote noise detector and the wireless receiver;

a noise reduction processor coupled to the wireless receiver; and an acoustic signal receiver, coupled to the noise reduction processor, for receiving an acoustic signal from a primary acoustic source;

wherein the noise reduction processor is configured for reducing or cancelling a noise component in said received acoustic signal based on said received noise estimate.

2. The noise reduction apparatus according to claim 1, wherein said acoustic signal receiver comprises a first microphone adapted to receive said acoustic signal from said primary acoustic source.

3. The noise reduction apparatus according to claim 1, wherein said noise reduction processor comprises a level adjustment unit for compensating a level difference between said received noise estimates and said noise component in said received acoustic signal based on a speech model on a frame-by-frame basis.

4. The noise reduction apparatus according to claim 1, wherein said noise reduction processor comprises a path estimation unit for estimating an acoustic path between said remote noise detector and said acoustic signal receiver.

5. The noise reduction apparatus according to claim 1, wherein said noise reduction processor comprises a speech enhancement unit for exploiting said received noise estimate by a single-channel speech enhancement algorithm.

6. The noise reduction apparatus according to claim 1, wherein said apparatus is adapted to connect to said remote noise detector via an ad hoc network connection.

7. A remote noise detector for detecting a background noise or interference and for wirelessly transmitting a noise estimate to a noise reduction apparatus, the remote noise detector comprising:

a level adjustment unit for compensating a level difference between a noise estimate and a noise component in an acoustic signal, wherein the noise estimate is power spectral density of a noise or interference remotely detected and wirelessly transmitted by at least one remote noise detector to a wireless receiver, and wherein the power spectral density is transmitted at a reduced spectral resolution in order to reduce a transmission bandwidth between the at least one remote noise detector and the wireless receiver; and a path estimation unit for estimating an acoustic path between the at least one remote noise detector and an acoustic signal receiver.

8. The remote noise detector according to claim 7, wherein said remote noise detector comprises a second microphone.

9. The remote noise detector according to claim 7, wherein said remote noise detector is adapted to connect to said noise reduction apparatus via an ad hoc network connection.

10. The remote noise detector according to claim 7, wherein said remote noise detector is adapted to transmit a time domain waveform to said noise reduction apparatus during a start-up phase, so as to enable path estimation.

11. A system for reducing at least one of background noise and interference during reception of an acoustic signal, said noise reduction system comprising:

a noise reduction apparatus for reducing at least one of background noise and interference during reception of an audio signal, said noise reduction apparatus comprising:

a wireless receiver for receiving a noise estimate;

a noise reduction processor coupled to the wireless receiver; and an acoustic signal receiver, coupled to the noise reduction processor, for receiving an acoustic signal from a primary acoustic source;

wherein the noise reduction processor is configured for reducing or cancelling a noise component in said received acoustic signal based on said received noise estimate; and at least one remote noise detector located close to at least one secondary acoustic source which generates said background noise or interference, wherein the received noise estimate is power spectral density of the background noise or interference remotely detected and wirelessly transmitted by at least one remote noise detector to the wireless receiver, and wherein the power spectral density is transmitted at a reduced spectral resolution in order to reduce a transmission bandwidth between the at least one remote noise detector and the wireless receiver.

12. A method of reducing at least one of background noise and interference during reception of an acoustic signal, said noise reduction method comprising:

wirelessly receiving a noise estimate from at least one remote noise detector, wherein the received noise estimate is power spectral density of the background noise or interference remotely detected and wirelessly transmitted by the at least one remote noise detector to a wireless receiver, and wherein the power spectral density is transmitted at a reduced spectral resolution in order to reduce a transmission bandwidth between the at least one remote noise detector and the wireless receiver, receiving an acoustic signal from a primary acoustic source, reducing or cancelling a noise component in said received acoustic signal based on said wirelessly received noise estimate.

* * * * *